US009757642B2

(12) United States Patent
Kaye

(10) Patent No.: US 9,757,642 B2
(45) Date of Patent: Sep. 12, 2017

(54) DEVICE FOR REVEALING A WINNER

(71) Applicant: Perry Teri Toys LLC, Davie, FL (US)

(72) Inventor: Perry Scott Kaye, Cooper City, FL (US)

( * ) Notice: Subject to any disclaimer, the term of this patent is extended or adjusted under 35 U.S.C. 154(b) by 78 days.

(21) Appl. No.: 14/600,411

(22) Filed: Jan. 20, 2015

(65) Prior Publication Data

US 2015/0375100 A1 Dec. 31, 2015

Related U.S. Application Data

(60) Provisional application No. 61/929,605, filed on Jan. 21, 2014.

(51) Int. Cl.

| | |
|---|---|
| ***G06F 17/00*** | (2006.01) |
| ***A63F 9/24*** | (2006.01) |
| ***A63F 11/00*** | (2006.01) |
| ***A63H 33/00*** | (2006.01) |
| ***A63H 33/22*** | (2006.01) |
| ***A63H 5/00*** | (2006.01) |
| *A63F 9/00* | (2006.01) |

(52) U.S. Cl.

CPC ..... *A63F 9/24* (2013.01); *A63F 11/0051* (2013.01); *A63H 5/00* (2013.01); *A63H 33/009* (2013.01); *A63H 33/22* (2013.01); *A63F 2009/0084* (2013.01); *A63F 2009/2442* (2013.01); *A63F 2009/2482* (2013.01); *A63F 2011/0072* (2013.01); *A63F 2250/485* (2013.01)

(58) Field of Classification Search

USPC ..... 463/44–47, 47.1–47.6

See application file for complete search history.

(56) References Cited

U.S. PATENT DOCUMENTS

| | | | | |
|---|---|---|---|---|
| 2004/0242300 | A1* | 12/2004 | Nicely | A63F 3/00157 463/16 |
| 2006/0287114 | A1* | 12/2006 | Luong | A63F 9/02 463/51 |
| 2015/0087389 | A1* | 3/2015 | Ratner | G07F 17/3262 463/20 |
| 2015/0157300 | A1* | 6/2015 | Ealovega | A61B 10/0096 600/574 |

* cited by examiner

*Primary Examiner* — Ronald Laneau

(74) *Attorney, Agent, or Firm* — Mederos Legal, PLLC; Diana Mederos

(57) ABSTRACT

The present invention relates to a device for revealing a winner. The current embodiments are in the field of toys and games and reveal a winner in play battle or sport. Specifically the device utilizes at least one sensing mechanism for revealing a winner. More specifically a device for revealing a winner can be Balloon Toys such as Balloon Swords. It uses sensing mechanisms to determine the moment a winner has won and then triggers a mechanism in the non-winners device to destroy itself. A device for revealing a winner may include a bladder fill able with fluid, a way to hold the bladder, a mechanism to detect a win event, a mechanism to notify the loser's equipment of the win event, and a mechanism to burst the bladder of the loser's battle/sport equipment based on their loss.

28 Claims, 23 Drawing Sheets

FIG. 15A

| Device A | Device B | WIN SENSOR Outcome |
|---|---|---|
| WIN sensor triggered | Nothing Triggered | Device A notifies Device B to burst its bladder |
| Nothing triggered | WIN sensor triggered | Device B notifies Device A to burst its bladder |
| Nothing Triggered | Nothing Triggered | Devices A and B do nothing |
| WIN sensor triggered | WIN sensor triggered | Device A notifies Device B to burst it bladder and Device B notifies Device A to burst its bladder |
| MAD button pressed | Nothing or Anything triggered | MAD (Mutually Assured Destruction) Device A bursts its bladder and notifies Device B to burst its bladder. All devices lose. |
| Nothing or Anything Triggered | MAD button pressed | MAD (Mutually Assured Destruction) Device B bursts its bladder and notifies Device A to burst its bladder. All devices lose. |

FIG. 15B

| Device A | Device B | LOSS SENSOR Outcome |
|---|---|---|
| LOSS sensor triggered | Nothing Triggered | Device A bursts its own bladder |
| Nothing Triggered | LOSS sensor triggered | Device B bursts its own bladder |
| Nothing Triggered | Nothing Triggered | Devices A and B do nothing |
| LOSS sensor triggered | LOSS sensor triggered | Device A bursts its own bladder<br>Device B bursts its own bladder |
| MAD button pressed | Nothing Triggered | Device A bursts its own bladder and notifies Device B to burst its bladder |
| Nothing triggered | MAD button pressed | Device B bursts its own bladder and notifies Device A to burst its bladder |

DEVICE FOR REVEALING A WINNER

CROSS-REFERENCE TO RELATED APPLICATIONS

This application claims the benefit of U.S. Provisional Application No. 61/929,605, filed Jan. 21, 2014, which is hereby incorporated by reference in its entirety for all purposes.

BACKGROUND OF THE INVENTION

The present invention generally relates to the field of sport or entertainment toys and games and methods of use of the same. More particularly, the present invention relates to sport or entertainment toys and games that utilize sensing mechanisms for detecting and revealing winners/losers and methods of use of the same.

Balloons have been used for many years as objects of play. Children and adults often use balloons as decorations and costumes, and for play battle/sport. The bright colors, low cost, lightweight and squishy nature of balloons make them a suitable toy for children and adults to enjoy. Children use toy balloon swords because they give each child a way to act out battle/sports without a risk of harm from their play weapon during play. Since balloons also have the tendency to light up they have been used to simulate light sabers. Balloons are also known for their ability to create a loud sound when they burst.

Clowns and entertainers have made balloon swords for decades. A thin balloon's long shaft is twisted into a shape having a long end leading to a simulated cross-guard just above a grip. A pommel is sometimes simulated by adding a twist and knot to the grip's end for the appearance of a real sword's pommel feature. These toys are common, fun and have inspired other toy sword inventions including devices that use a balloon attached to a grip to simulate a sword with a light in the handle to make the balloon glow and a pump in the handle can blow up the balloon. This lets players simulate battle/sport but does not offer a clear indication of win. This lack of certainty often causes fights amongst players. We often hear kids, in fantasy battle/sport, say things like, "You didn't win because I hit you first", or "you would have dropped the sword before you hit me because I got your leg." While these tussles are often minor they do make it difficult to keep score and cause delays during play. Sometimes feelings are hurt and the enjoyment of the battle/sport is lessened. There is a need for a clear winner in a fantasy battle/sport.

Other inventions attempt to solve the problem, caused by a lack of clear winner indication, by using a sound generating mechanism to indicate a win. One example shows a play sword with an ability to pop an internal balloon when pressure is applied to the sword's tip. An unfortunate problem with this invention is that the winner, the victor of the play battle/sport, is the one whose weapon is damaged to indicate the win. This means that even though the player won the battle/sport they are the person who loses a feature of their own sword. To remedy this problem the patent shows, in different embodiments, the use of a sound generator instead of a balloon. But the sounds created by the sound generator are not nearly as loud or instantaneous as the sounds created by a balloon popping.

The problems with prior technologies are clear. In prior technologies game play is often made less exciting by not clearly indicating the real and actual winner of the game. Play battle/sport equipment without an ability to indicate a win often leads to arguments. Technology that destroys or damages the winner's equipment to indicate a win is counterintuitive and disheartening to the winner. In prior technology, players are either left to argue over who was truly victorious or the winner is punished for their victory.

SUMMARY OF THE INVENTION

Objects of the present invention include at least one of revealing the winner of a play game of battle or sport; creating a positive indication of win; creating a positive indication of loss; producing a rapid and loud noise at the point-in-time that the win takes place; creating a safe and entertaining way to play battling and sporting games; rewarding the winner by destroying the loser's weapon and/or tools to wage war; providing a simple and quick way for losing players to fix their weapons and fight again; providing a public display of loss; providing a public display of win; and/or providing play battle/sport players a more exciting play pattern.

Other objects and advantages of the present invention will become apparent from the following descriptions, taken in connection with the accompanying drawings, wherein, by way of illustration and example, an embodiment of the present invention is disclosed.

In accordance with a particular embodiment of the invention, there is disclosed a device for revealing a winner in play battle/sport comprising: a bladder fillable with fluid, a structure to hold the bladder, a mechanism to detect a win event, a mechanism to notify the loser's equipment of their opponent's win and thus their loss, and a mechanism to burst the bladder of the loser's equipment.

In accordance with this particular embodiment of the invention, there is disclosed a process for revealing a winner in play battle/sport comprising the steps of: determining the winner in a play battle/sport, notifying the loser's equipment of their own loss and causing the loser's equipment to burst their own bladder.

In accordance with this particular embodiment of the invention, there is disclosed an alternative device for revealing a winner in play battle/sport comprising: a bladder fillable with fluid, a structure to hold the bladder, a mechanism to detect a lose event, a mechanism to notify the loser's equipment of their opponent's win and thus their loss, and a mechanism to burst the bladder of the loser's equipment.

In accordance with this particular embodiment of the invention, there is disclosed an alternate process for revealing a winner in play battle/sport comprising the steps of: determining the loser in a play battle/sport, notifying the loser's equipment of their own loss and causing the loser's equipment to burst their own bladder.

BRIEF DESCRIPTION OF THE SEVERAL VIEWS OF THE DRAWING

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 10A shows the invention with a manually operated pump and a deflated bladder. FIG. 10B shows the invention with a manually operated pump and an inflated bladder.

FIGS. 15A and 15B show a diagram detailing the actions that components of the present invention take based upon sensors being triggered to report a win or loss respectively.

DETAILED DESCRIPTION OF THE INVENTION

Detailed descriptions of particular embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1A:
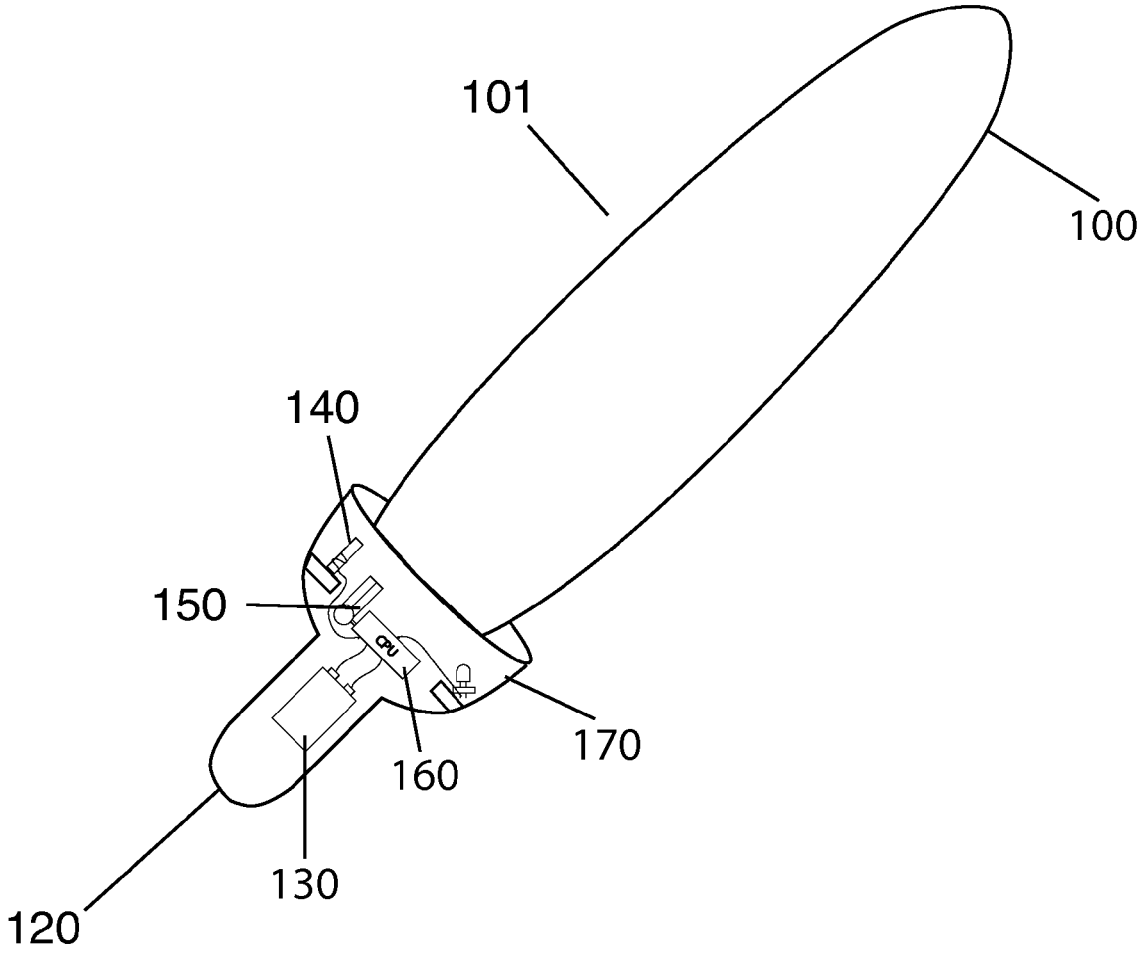
FIG. 1A is a side view of the internal and external portions of a sword embodiment of the present invention.
Figure 1B:
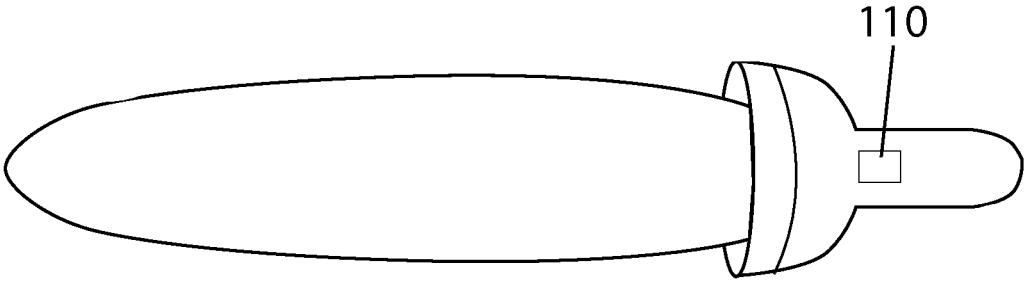
FIG. 1B is a side view of the external portions of a sword embodiment of the present invention.

FIGS. 1A and 1B show a sword embodiment of the present invention. In FIG. 1A bladder 100 is filled with a fluid and is attached to bladder holder 170. Bladder holder 170 is attached handle 120 and connects bladder 100 to handle 120. Battery 130. The at least one battery may be housed within at least one battery compartment (not shown here or numbered). The battery powers a logic circuit 160, which monitors sensor 140, which can be a pressure sensor. Once logic circuit 160 determines that sensor 140 indicates a winning event it communicates with opponent's sword, via transmitters (not shown), and opponent's sword receives the communication through receivers (not shown) that the opponent's sword should burst its own bladder 100. Each sword has transmitters (not shown) and receivers (not shown) through which they can communicate. When an indication of loss is detected by the logic circuit 160 receiving a loss message at a receiver (not shown), a motor with a needle 150 attached is turned on and the needle 150 bursts the bladder 100. The power switch 110 in FIG. 1B turns the device on and off. This embodiment, as well as other embodiments, may include a scorning device, which is not depicted in the drawings.

Embodiments of the invention described herein provide the advantage of enabling two or more players to freely play battle games with the certainty of a win for one of the players being revealed by the two or more devices. Embodiments of the invention may use transmitters and/or receivers for communication between the two or more devices via infrared, radio control, Bluetooth®, sound, light and/or other technologies.

Figure 2:
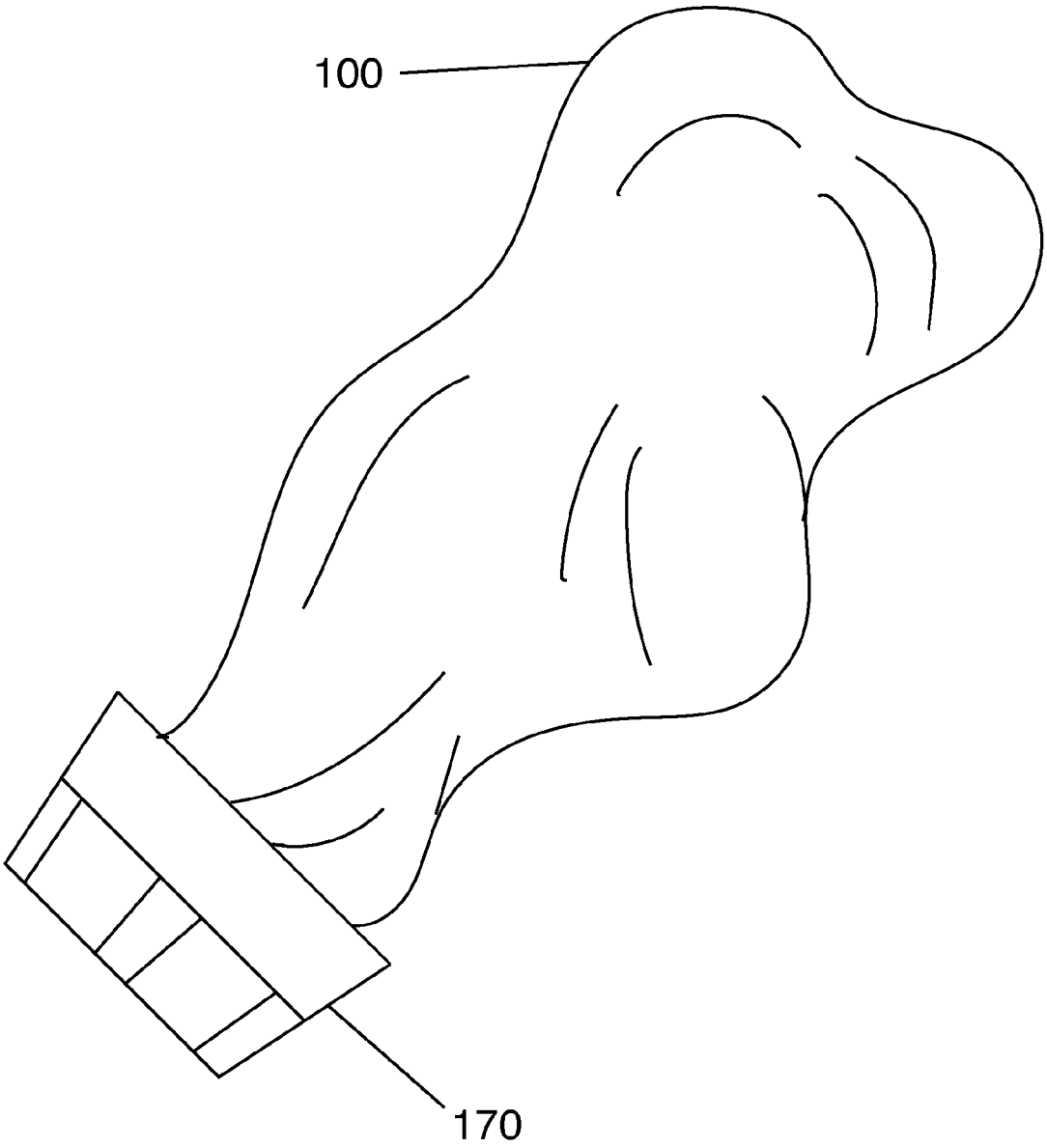
FIG. 2 is a side view of a deflated bladder attached to a bladder holder.

FIG. 2 shows a bladder 100 that is not inflated and is attached to a bladder holder 170.

Figure 3:
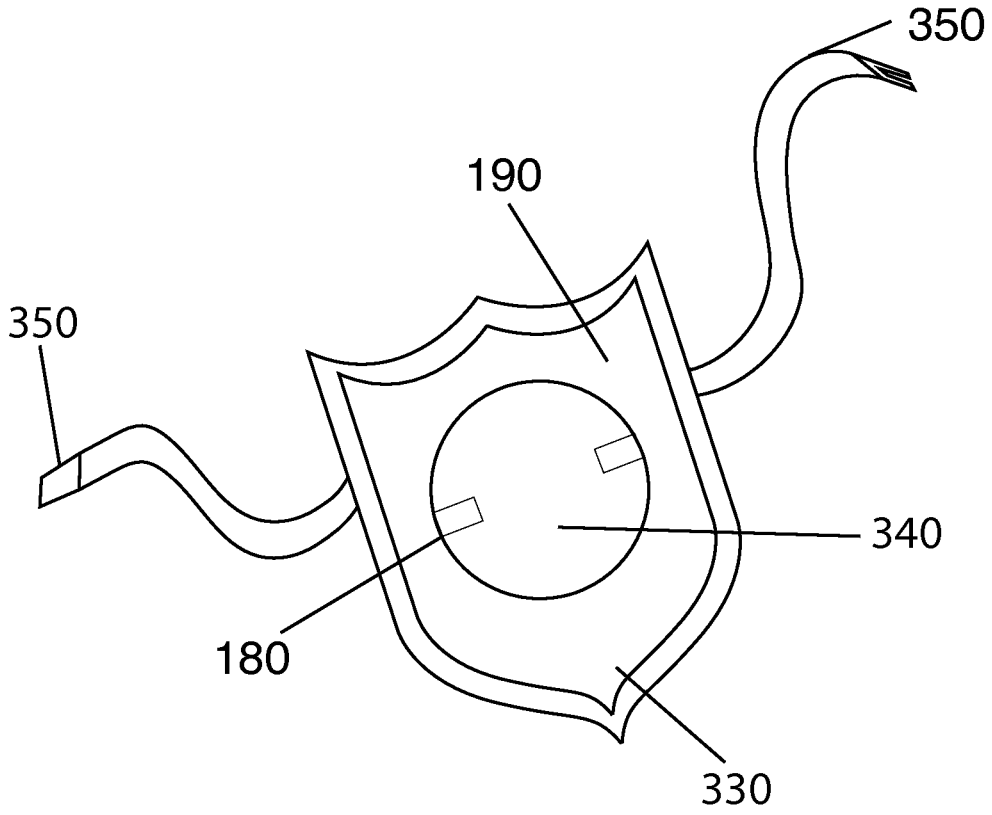
FIG. 3 is a rear view of a shield embodiment of the invention.

FIG. 3 shows a shield embodiment of the present invention. The shield 330 has a sensing mechanism 340 at its center. In this particular embodiment of the invention a transmitter 180 sends a beam/signal to a receiver 190. A broken beam/signal is an indication that the user holding the device with the broken beam/signal has lost. The logic circuit (not shown) in the shield 330 will notify the losing device using transmitter 180 and/or receiver 190 at the direction of an internal circuit, that it, the non-winning device, should burst itself and thus inform the winner they have won. Upon winning a winner's device can make noise, flash lights and/or vibrate to celebrate. Straps 350 enable a player to wear a shield 330 or hang it for storing during nonuse.

Figure 4:
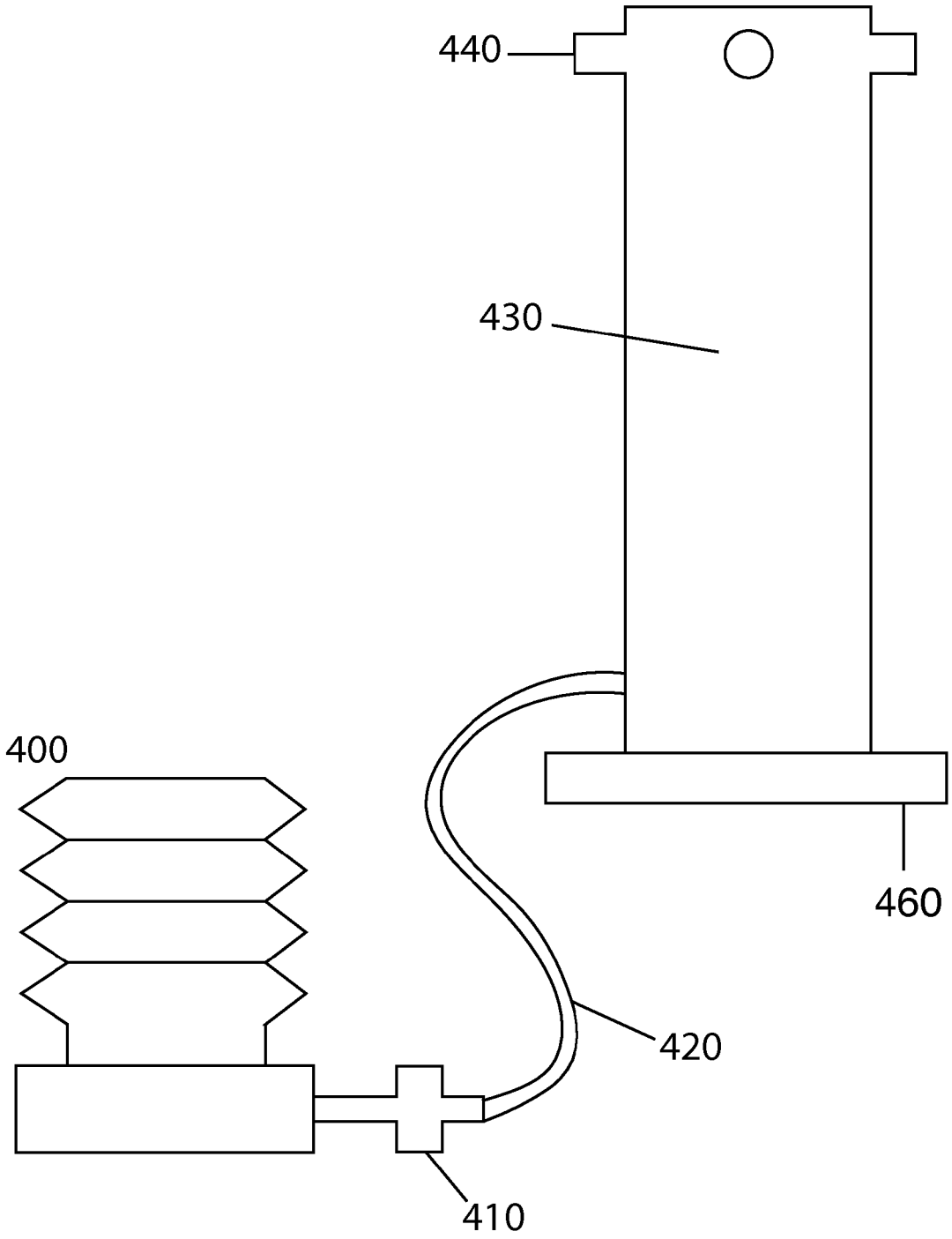
FIG. 4 is a side view of an external bladder inflation system.

FIG. 4 shows an embodiment of an external bladder inflation system that is designed to quickly fill a bladder that is or can be attached to a bladder holder. External bladder inflation system uses a manually operated pump 400 with a check valve 410 and supply hose 420 to remove fluid from the inflation chamber 430. A base 460 keeps the inflation chamber 430 steady when the inflating chamber 430 and/or the pump inflation device is in use. The bladder (not shown) is held in place by attachment boss(es) 440, which create a fluid-tight seal in the inflation chamber 430 when a bladder is attached.

Figure 5:
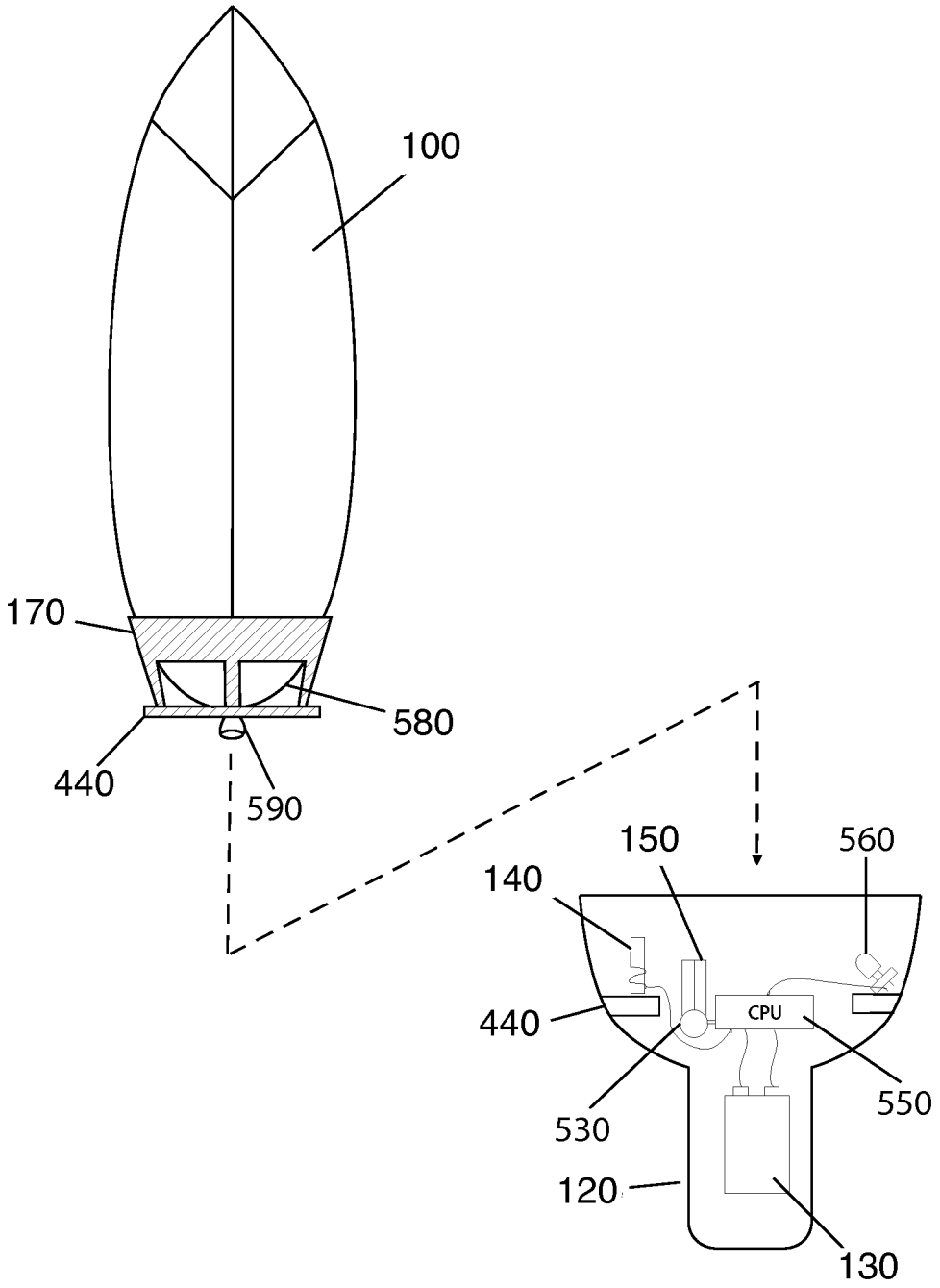
FIG. 5 is a semi-exploded view of a bladder attached to a bladder holder and a handle, with the view of the handle being a cut side view.

FIG. 5 shows a sword embodiment of the present invention with a bladder 100 attached to bladder holder 170. Attachment boss 440 enables bladder holder 170 to be snapped into handle 120 by latching said attachment boss 440 onto/into another attachment boss 440 in a twist or other fashion. Fluid containment knot 590 is tied and closed at the open end of the bladder 100 once the bladder 100 has been filled. The location to burst bladder 580 is designed to enable predictable bursting by giving a clean and open space for the needle 150 to contact the bladder 100. Handle 120 contains a battery 130 that powers a CPU with software 550, which performs functions of the device including powering the light emitting diode (LED) 560 on and off, and controlling the brightness and patterns of light, if any, of the LED 560. The CPU with software 550 also checks the sensor 140 for an indication of a win, bursts the bladder 100 by powering on a motor 530, which moves needle 150 to burst the bladder 100, and communicates with an opponent's device to relay the message of a win or loss.

Figure 6:
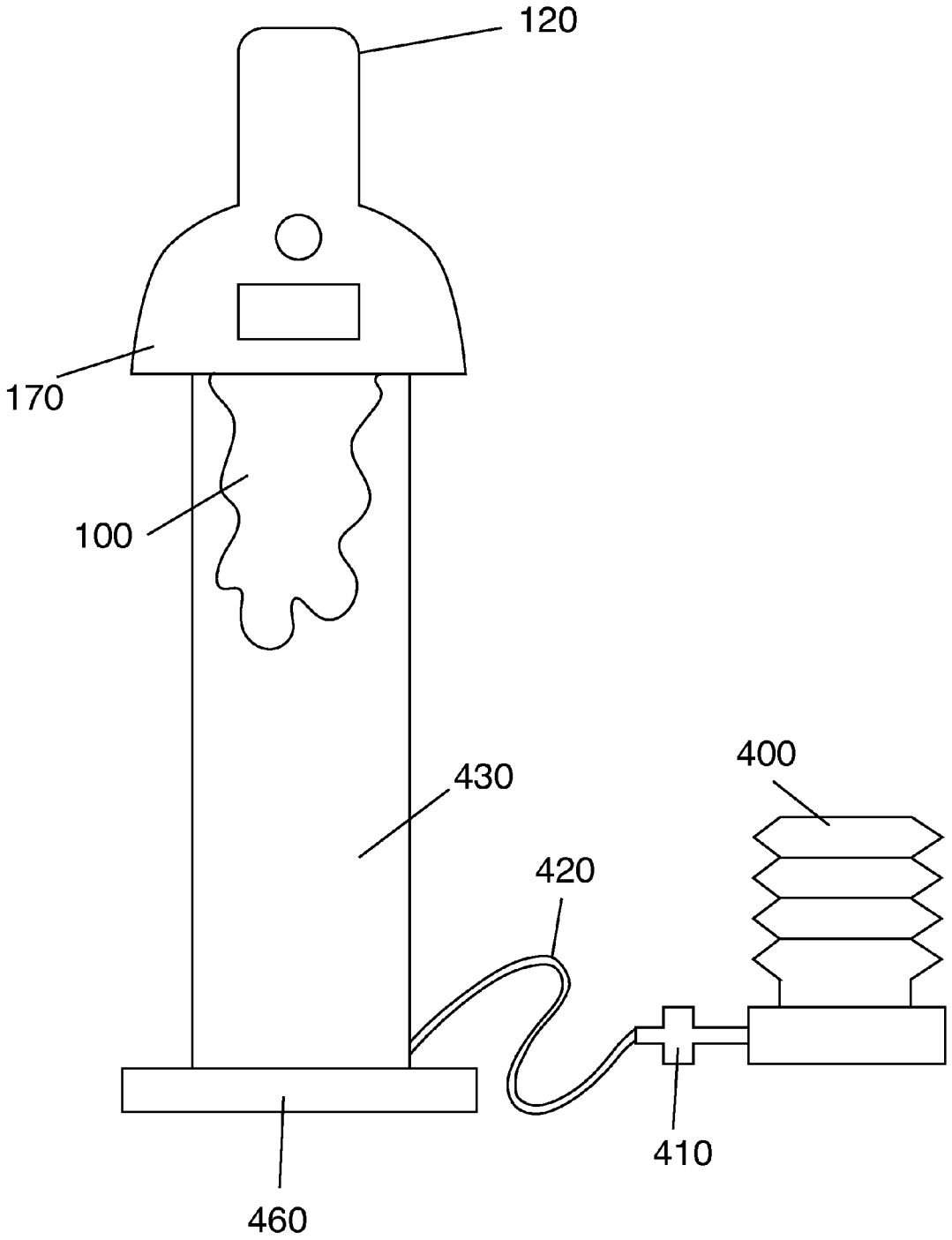
FIG. 6 is a side view of an external bladder inflation system with a deflated bladder.
Figure 7:
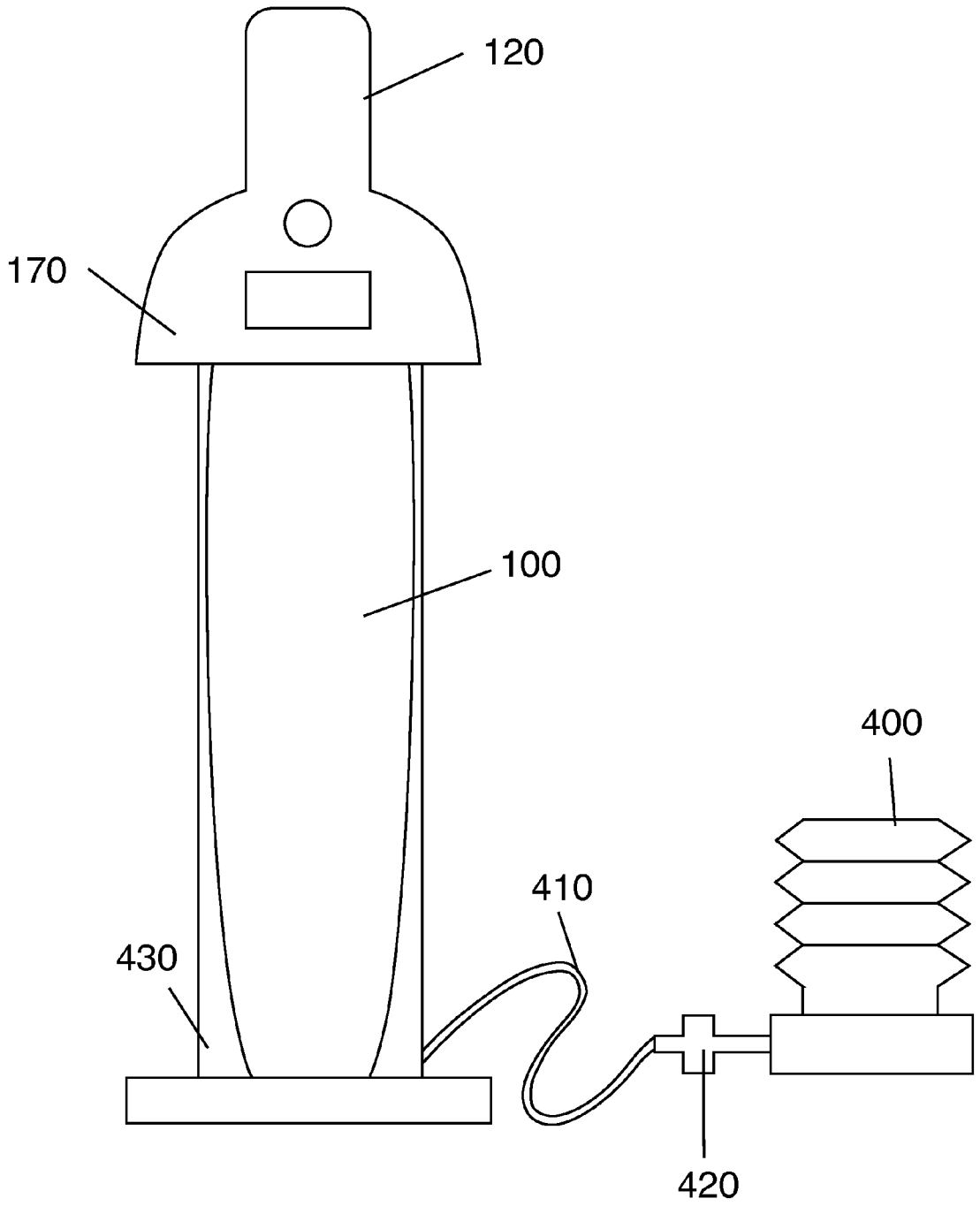
FIG. 7 is a side view of an external bladder inflation system with an inflated bladder.
Figure 8:
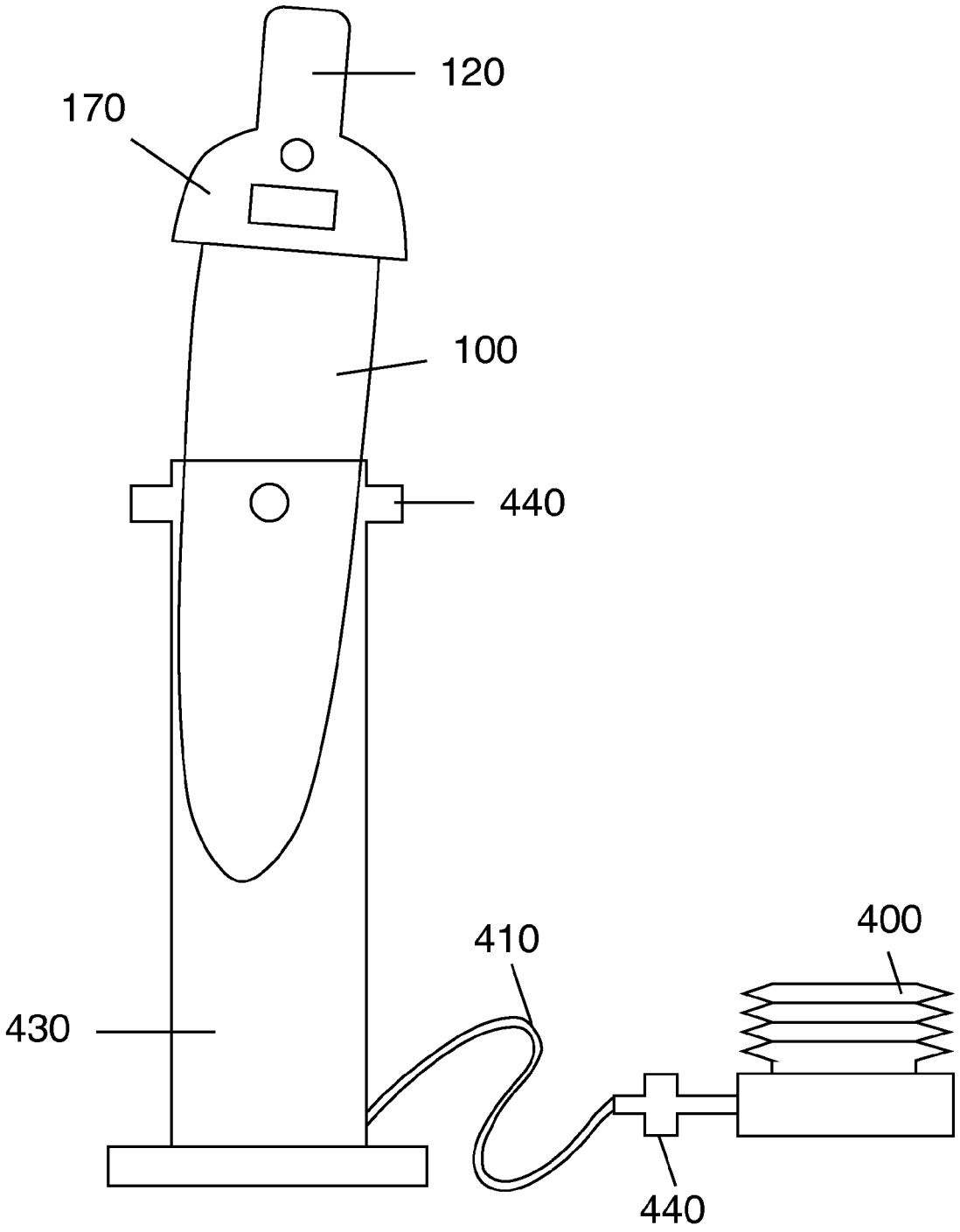
FIG. 8 is a side view of an external bladder inflation system with an inflated bladder being removed from said device.

FIG. 6 shows external bladder inflation system with inflation chamber 430 containing a deflated bladder 100 attached to a bladder holder 170 and handle 120. When manually operated pump 430 is pressed said pump will remove fluid from the inflation chamber 430 via supply hose 420 while check valve 410 keeps the inflation chamber 430 in a vacuum state. The bladder 100 will have an open end, which provides an entryway for the fluid to fill the bladder 100 as the vacuum in the inflation chamber 430 increases. FIG. 7 show that as the vacuum gets greater the bladder 100 consumes more space in the inflation chamber 430. FIG. 8 shows the combination of the inflated bladder 100, the bladder holder 170, and the handle 120 being removed from the inflation chamber 430 via the twist and/or other detachment motion of the attachment boss 440 from the other attachment boss (not shown). The twist and/or other detachment motion closes and/or seals the open end of the bladder 100 and causes and breaks the vacuum seal in the inflation chamber 430 by opening an activating rotary valve 900 (shown in FIG. 9).

Figure 9:
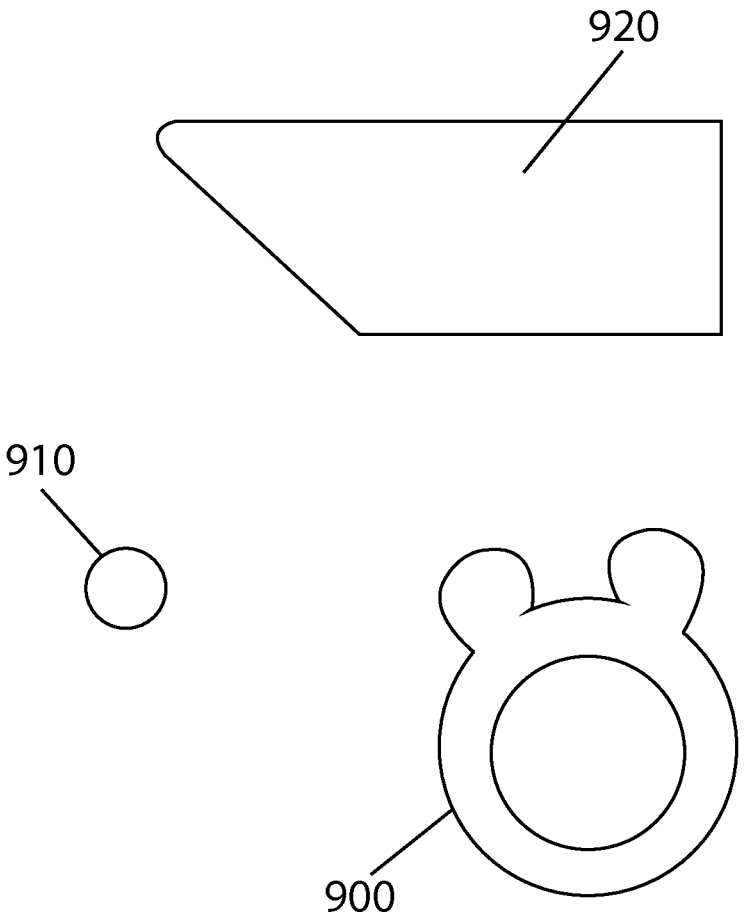
FIG. 9 is a diagram showing how a valve is open and/or closed by components of the present invention.

FIG. 9 shows a diagram of a retention boss 920, on inflation chamber and sword's lock pin 910 activating rotary valve 900.

Figure 10A:
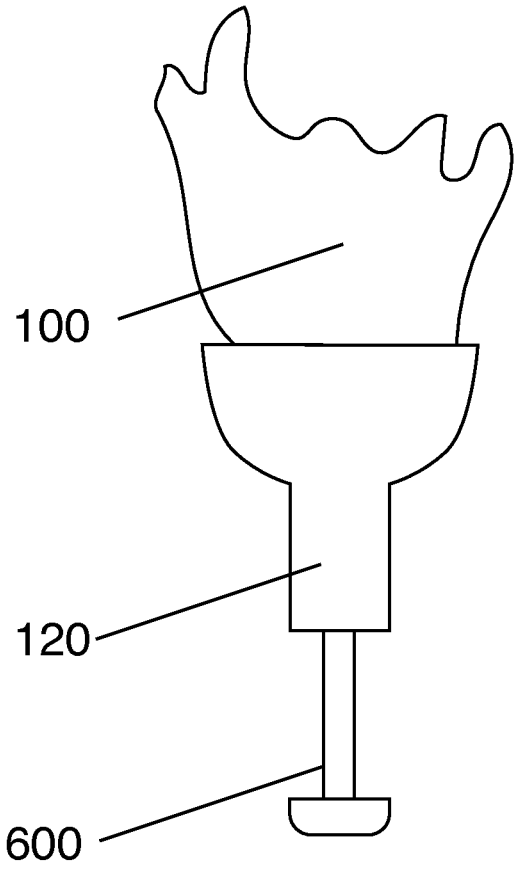
FIGS. 10A and 10B are side views of an embodiment of the invention that includes a manually operated pump to enable a bladder to be pumped up.
Figure 10B:
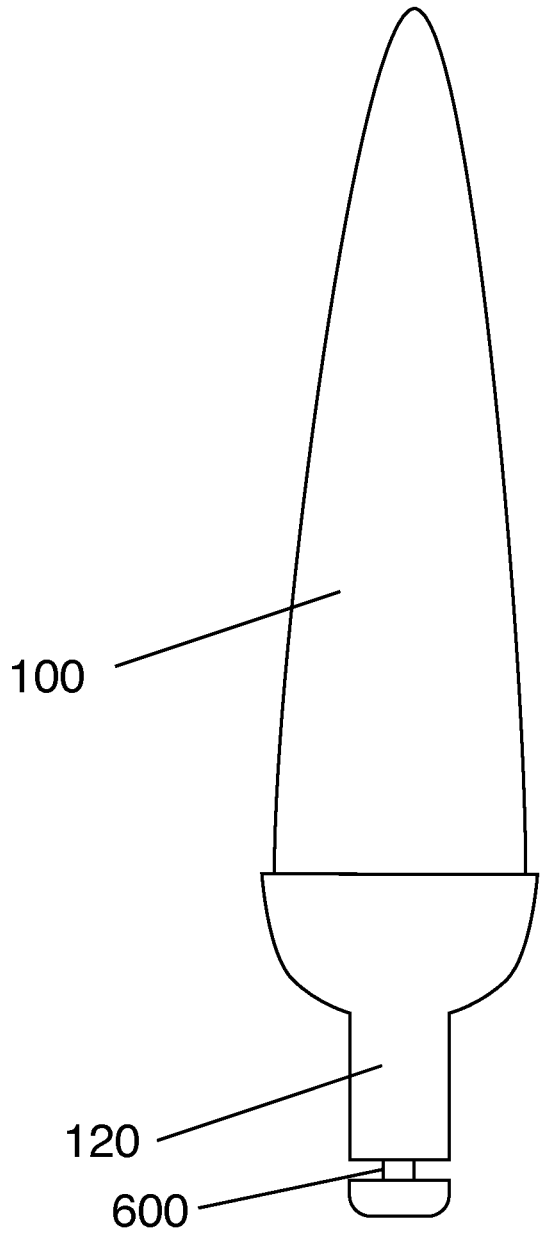

FIG. 10A shows a sword embodiment of the present invention with a deflated bladder 100 and a built-in contact attachment inflation system 600 in a loaded position. FIG. 10B shows a sword embodiment of the present invention with an inflated bladder 100 and a built-in contact attachment inflation system in an unloaded position. The built-in contact attachment inflation system 600 forces air and/or fluid into the bladder 100 as the built-in contact attachment inflation system 600 is pushed from a loaded position shown in FIG. 10A into the handle 120 and into an unloaded position shown in FIG. 10B. The mechanism(s) used to detect and/or reveal win/loss and/or communicate the results of a game to the other devices and burst a bladder, if necessary, are not shown in FIGS. 10A and 10B but are located inside the handle 120 and/or bladder holder 170.

Figure 11:
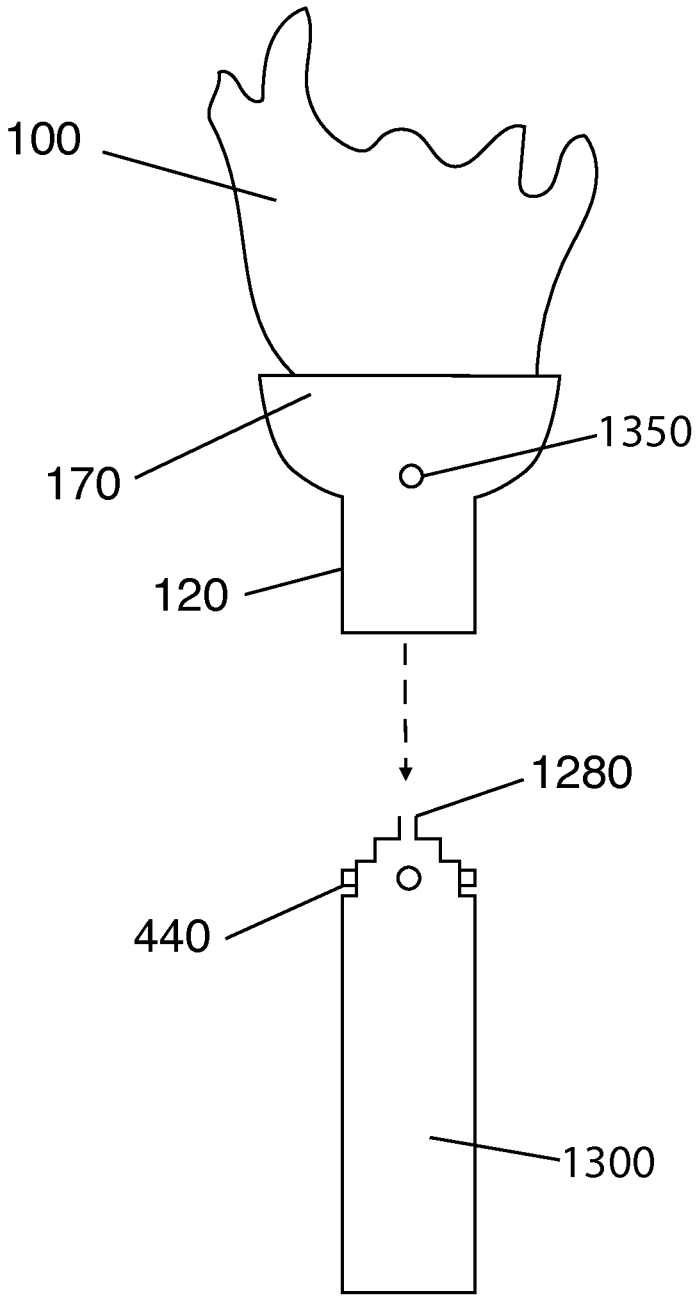
FIG. 11 is a side view of a sword embodiment of the present invention with a built-in contact attachment inflation system.

FIG. 11 shows a side view of a sword embodiment of the present invention that uses a compressed fluid cartridge 1300 with attaching boss(es) 440 and cartridge nozzle 1280. The user inserts the compressed fluid cartridge 1300 into the bladder holder 170 via the handle 120 and twists to lock it in place through the interfacing of the attaching boss(es) 440 located on the compressed fluid cartridge 1300 and the attaching boss(es) (not shown) located on the bladder holder 170 or handle 120. When the user presses the inflation button 1350 the fluid located in the compressed fluid cartridge 1300 enters into and inflates the bladder 100. The compressed fluid cartridge 1300 can be replaced by an electric or manually operated pump (not shown), which can be inserted and locked into the bladder holder 170 in a similar fashion to that of the compressed cartridge 1300.

Figure 12:
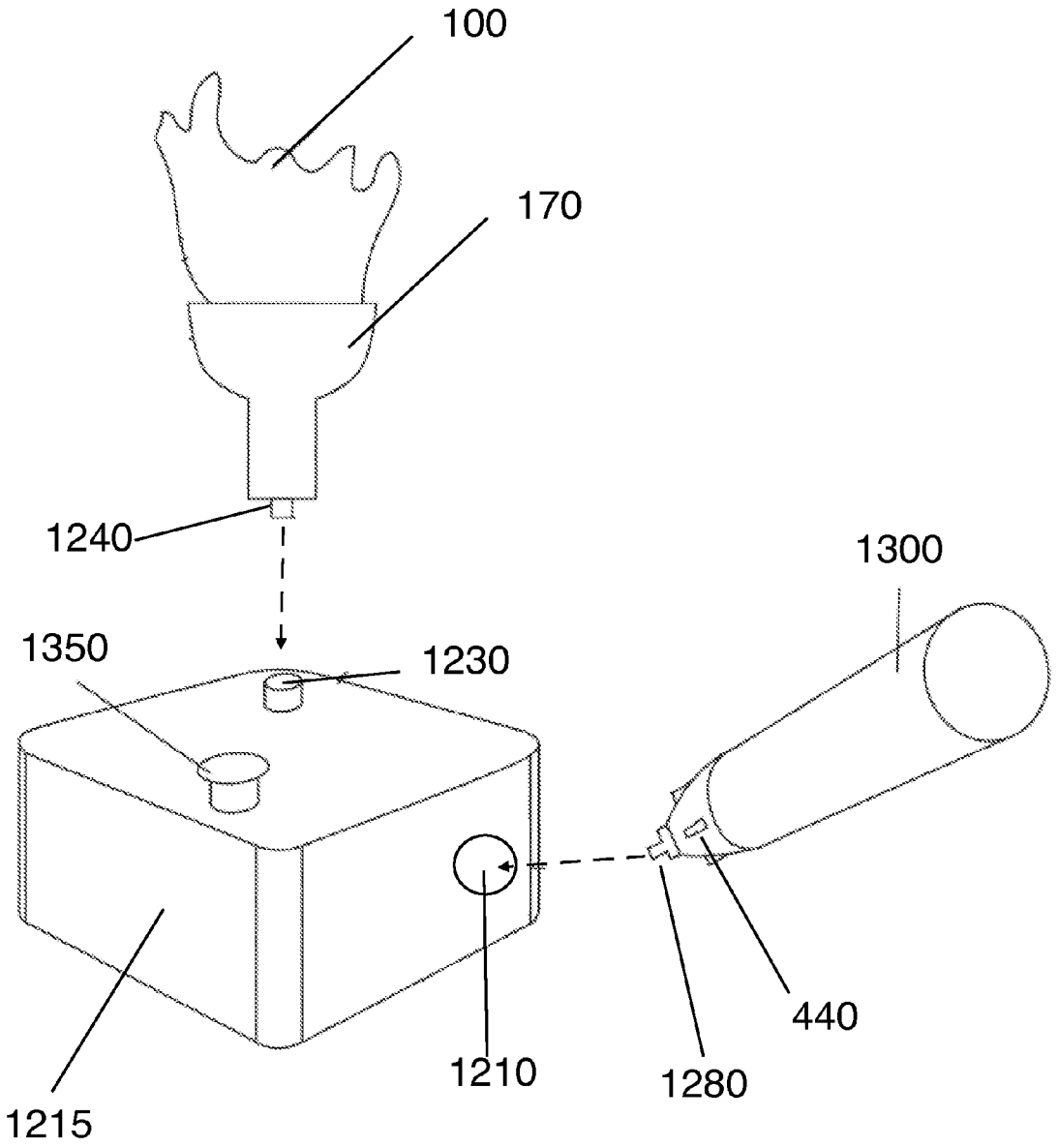
FIG. 12 provides a semi-exploded view of the components of an inflation station.

FIG. 12 shows an inflation station 1215 with inflation button 1350 and inflation nozzle 1230, which supplies fluid from a compressed fluid cartridge 1300 that is inserted into cartridge holder 1210 and locked into place with attaching boss(es) 440. Compressed fluid cartridge 1300 interfaces with cartridge nozzle 1280 to enable inflation nozzle 1230 to supply fluid to device valve 1240 and fill bladder 100. After user installs a compressed fluid cartridge 1300 into the inflation station 1215 the user then presses the device valve 1240 to the inflation nozzle 1230 and the inflation button 1350 thus releasing fluid from the compressed fluid cartridge 1300 into the bladder 100. The compressed fluid cartridge 1300 can be replaced by an electric or manually operated pump (not shown), which can be inserted and locked into the cartridge holder 1210. The inflation button 1350 can also open the device valve 1240 to allow fluid to pass into the bladder.

Figure 13A:
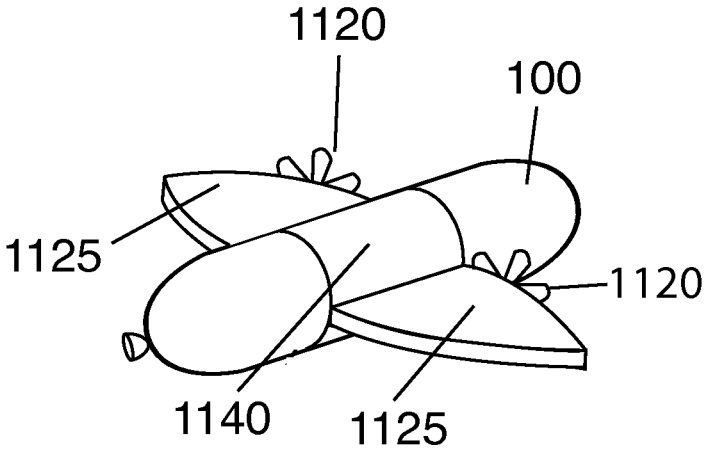
FIGS. 13A-13C show a series of various embodiments of the invention used in flying vehicles that are controlled by the controller shown in FIG. 13D.
Figure 13B:
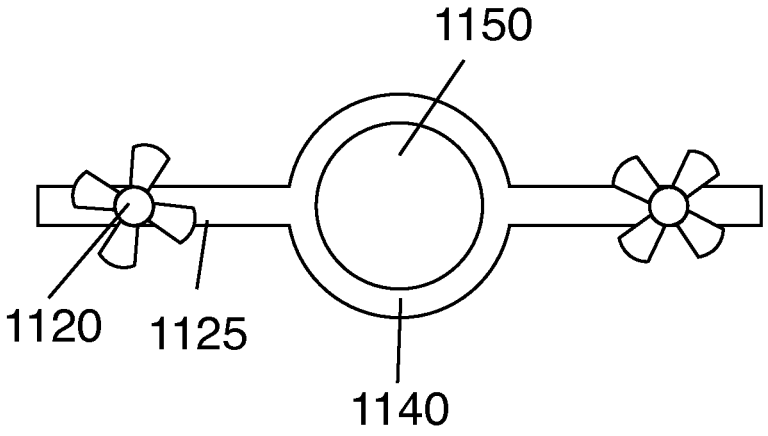
Figure 13C:
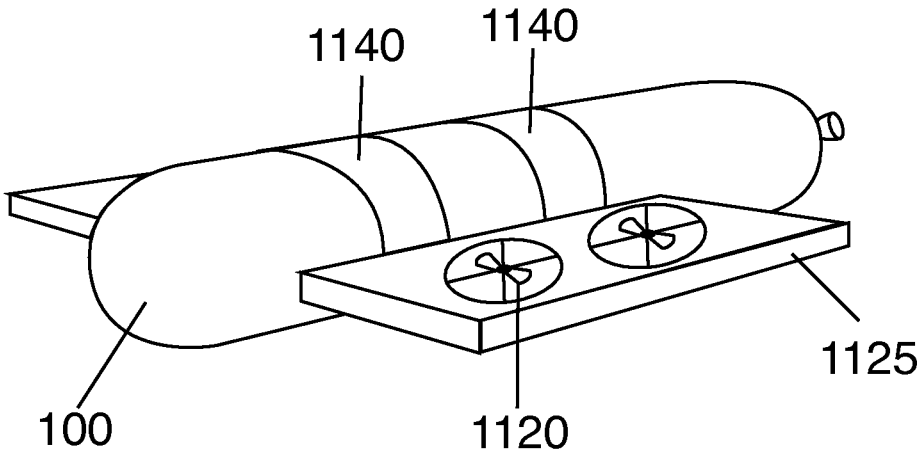
Figure 13D:
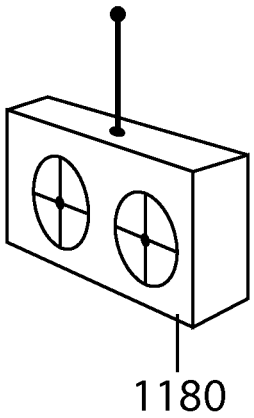

FIGS. 13A-13C show a series of various embodiments of the invention that enable the invention to be used in vehicles that are controlled by a controller 1180 shown in FIG. 13D. FIG. 13A shows a side view of a bladder 100 acting like the fuselage of an RC plane and propellers 1120 attached to wings 1125 that are triangular in shape, which are attached to the loop 1140. FIG. 13B shows a front view of loop 1140 and loop cavity 1145 with propellers 1120 attached to wings 1125. The bladder 100 is inserted and/or inflated in the loop cavity 1145 and is held in place by the loop 1140. FIG. 13C shows a side view of a bladder 100 acting like the fuselage of an RC plane and propellers 1120 attached to wings 1125 that are quadrilateral shaped, which are attached to the loop 1140. The propellers 1120 and the wings 1125 propel the bladder 100 in flight. The embodiments of the invention in FIGS. 13A-13C are controlled by the controller 1180 in FIG. 13D. The controller 1180 can use infrared, radio control, Bluetooth®, sound, light and/or other technologies in order to control the embodiments of the invention described in FIGS. 13A-13C. Dog fights, battles and/or challenges are waged between players. When an indication of win is created the non-winner's device bursts its own bladder. Thus the plane would fall to the ground.

Figure 14A:
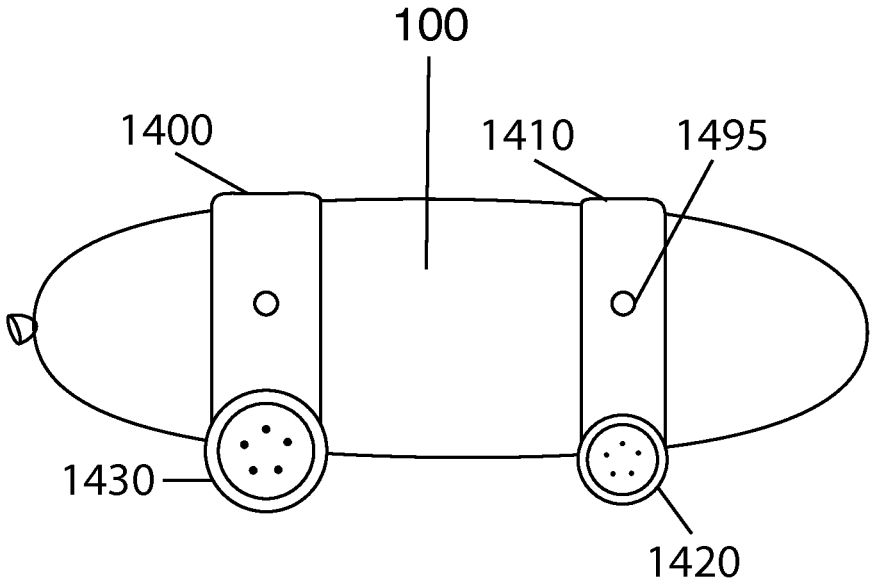
FIG. 14A shows a side view of an assembled vehicle utilizing the front assembly shown in FIG. 14B and the back assembly shown in FIG. 14C.
Figure 14B:
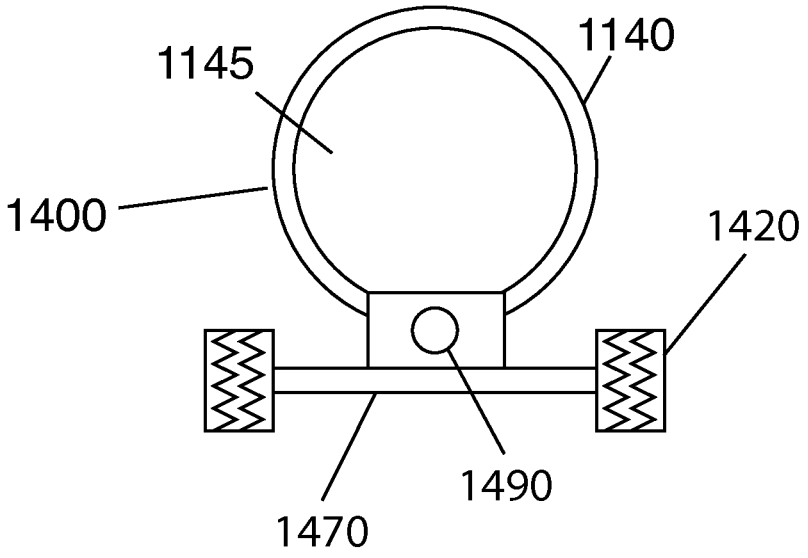
FIG. 14B shows a front view of a front assembly of a vehicle that utilizes an embodiment of the present invention.
Figure 14C:
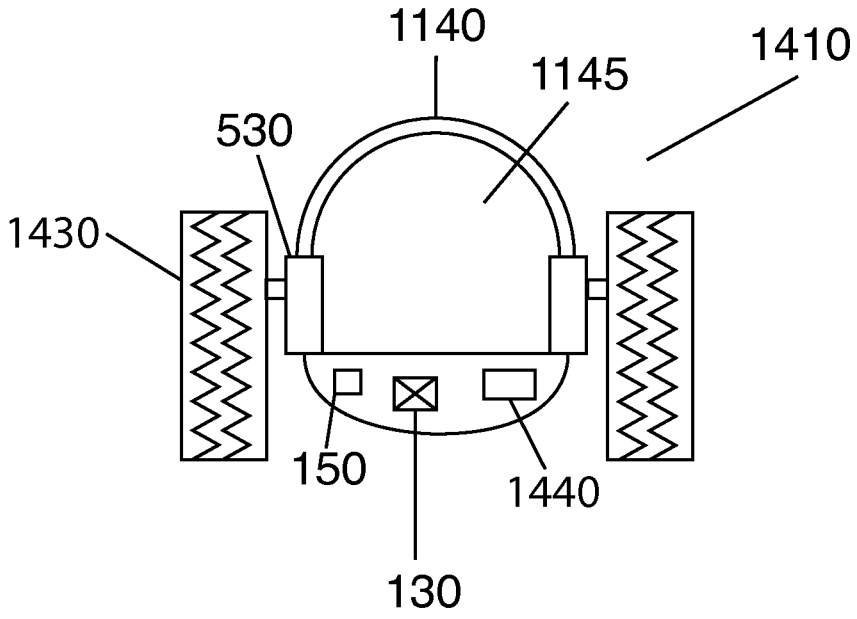
FIG. 14C shows a front view of a rear assembly of a vehicle that utilizes an embodiment of the present invention.

FIG. 14A shows a side view of an assembled remote controlled vehicle utilizing the front assembly shown in FIG. 14B and the back assembly shown in FIG. 14C. A bladder 100 is in the loop cavity 1145 created by the loop 1140 and acts as the body of the device. Once assembled with inflated bladder 100 acting as the main structure and being inflated through loop 1140, in the front assembly 1400 and rear assembly 1410, the user controls the device through an RC controller (not shown). The remote control can use infrared, radio control, Bluetooth®, sound, light and/or other technologies in order to control the embodiments of the invention described in FIGS. 14A-14C. The device can also be controlled via the on-board computer 1440 located on the rear assembly 1410. Based on the commands the device will be able to steer by control box 1470, which directs the front wheels 1420. Motors 1485 that drive the rear wheels 1430 move the vehicle. The front wheels 1420 and rear 1430 wheels can be weighted to account for any lack of weight in the device. Rear assembly 1410 includes a battery 130, computer 1440, needle and/or pin and assembly 150, motor 1485, loop cavity 1145, sensor 1495 and wheels 1430. Front assembly 1400 includes wheels weighted to hold down the bladder, which is held in the loop 1140, and enable steering by control box 1470 which is controlled by the computer 1440 and a wireless communication means linking the control box 1470 to the computer 1440, receiving sensors 1495 and Transmitting Sensor 1490. When the transmitting sensor 1490 sends a "Fire" command if the receiving sensor 1495 on an opponent's vehicle can read it that will cause the bladder buster assembly 1460 to burst the bladder of the hit vehicle. The computer 1440 controls the steering wheels 1420 by sending commands to it through a communication means, like transmitter/receiver and a motor reacts to the commands moving the wheels so they turn left or right at the direction of the user.

FIGS. 15A and 15B shows a diagram explaining the actions that components of the present invention take based upon sensors being triggered to report a win or loss respectively. If a player's sword determines he has inflicted a lethal blow to his opponent, the winning player's sensing mechanism triggers the actions outlined in FIG. 15A. If a player's sword determines he has received a lethal blow from his opponent, the losing player's sensing mechanism triggers the actions outlined in FIG. 15B.

While the invention has been described in connection with particular embodiments, it is not intended to limit the scope of the invention to the particular form set forth, but on the contrary, it is intended to cover such alternatives, modifications, and equivalents as may be included within the spirit and scope of the invention as defined by the appended claims.

COMPONENT LIST FOR DRAWINGS

Following is a list of the numbered components depicted in the drawings:

| Component Number | Component Description |
|---|---|
| 100 | Bladder (i.e. contact attachment) |
| 101 | Sword embodiment of the invention |
| 110 | Power Switch (i.e. switch or other circuit activating and/or deactivating device) |
| 120 | Handle (i.e. means for holding, manipulating, using, battling, competing, playing with the device) |
| 130 | Battery (i.e. power source operably connected to at least one component of the device) |
| 140 | Sensor (i.e. mechanism to detect at least one of contact, occurrences, event(s), scores, points, wins, losses, and/or a win or lose event(s)) |
| 150 | Needle and/or Pin and Assembly |
| 160 | Logic Circuit (i.e. circuitry associated with at least one of operating, running, and/or controlling at least one of the components of the device and/or the at least one power source) |
| 170 | Bladder Holder (i.e. means to hold in place, secure, snap-in place, attach, twist into place, and/or lock into place the at least one contact attachment) |
| 180 | Transmitter |
| 190 | Receiver |
| 330 | Shield embodiment of the invention |
| 340 | Sensing Mechanism (i.e. locating and/or sensing mechanism) |
| 350 | Strap |
| 400 | Manually-Operated Pump |
| 410 | Check Valve |
| 420 | Supply Hose |
| 430 | Inflating Chamber |
| 440 | Attachment Boss |
| 460 | Base |
| 530 | Motor |
| 550 | CPU (Logic Circuit) with software (i.e. Software is "a controlling and/or operating software application utilized to control or operate at least one of at least one receiver, at least one controller, at least one transmitter, and/or at least one transmitter/receiver") |
| 560 | LED |
| 580 | Location to Burst Bladder |
| 590 | Fluid Containment Knot |
| 600 | Built-In Contact Attachment Inflation System |
| 900 | Activating Rotary Valve |
| 910 | Lock Pin |
| 920 | Retention Boss |
| 1120 | Propeller |
| 1125 | Wing |
| 1140 | Loop |
| 1145 | Loop Cavity |
| 1180 | Remote controller (i.e. controller) |
| 1210 | Cartridge Holder |
| 1215 | Inflation Station (the inflation system housing unit) |
| 1230 | Inflation Nozzle |
| 1240 | Device Valve |
| 1280 | Cartridge Nozzle |
| 1300 | Compressed Fluid Cartridge |
| 1350 | Inflation Button |
| 1400 | Front Assembly |
| 1410 | Back Assembly |
| 1420 | Front Wheel(s) |
| 1430 | Back Wheel(s) |
| 1440 | Computer |
| 1460 | Control Box |

DEFINITIONS

As used herein, the term "and/or," when used in a list of two or more items, means that any one of the listed items can be employed by itself, or any combination of two or more of the listed items can be employed. For example, if a device is described as containing components A, B, and/or C, the composition can contain A alone; B alone; C alone; A and B in combination; A and C in combination; B and C in combination; or A, B, and C in combination.

"Logic Circuit", as used herein, means a circuit or mechanism with an ability to determine an outcome, such as a logic circuit, microprocessor/embedded-controller with software or a mechanical device with a pressure sensor based on a spring or magnet set to disengage at a set weight. In many embodiments an MCU (micro control unit) or embedded controller or CPU will have software that enables it to read sensors and then perform actions based on the triggering of the sensors. The actions can be to burst the bladder or to notify the other device to burst its bladder. Reading of the sensors, including win or loss indications and also messages from other devises informing of wins/losses. Actions can include bursting bladders, sending and decoding messages, playing sounds, keeping score, lighting lights and calculating and notifying players when events start and when they end (battle rounds for example).

The term "Attachment Boss", as used herein, is a protrusion, preset, recess or other opening and/or means designed to enable two elements to be joined together. An example of an attachment boss would be snap fit plastic components.

What is claimed:

1. A device for revealing a winner comprising:

at least one contact attachment;

at least one means to hold in place, secure, snap-in place, attach, twist into place, and/or lock into place the at least one contact attachment;

at least one means for holding, manipulating, using, battling, competing, playing with the device;

at least one mechanism to detect at least one of contact, occurrences, event(s), scores, points, wins, losses, and/or a win or lose event(s);

at least one power source operably connected to at least one component of the device;

at least one switch or other circuit activating and/or deactivating device;

circuitry associated with at least one of operating, running, and/or controlling at least one of the components of the device and/or the at least one power source;

at least one locating and/or sensing mechanism;

at least one receiver;

at least one controller;

at least one transmitter;

at least one transmitter/receiver;

a controlling and/or operating software application stored in at least one logic circuit and utilized to control or operate at least one of at least one receiver, at least one controller, at least one transmitter, and/or at least one transmitter/receiver;

at least one motor;

at least one needle and/or pin and assembly;

at least one strap;

means for making noise and/or sound, creating light and/or flashing lights, vibrating, and/or creating any other celebration display on and/or from said device;

at least one built-in contact attachment inflation system; and/or at least one housing unit.

2. The device for revealing a winner of claim 1 whereby the at least one contact attachment is at least one bladder.

3. The device for revealing a winner of claim 2 whereby the at least one bladder can be filled in whole or in part with at least one of gas, solid, mixture, compound, substance, and/or liquid.

4. The device for revealing a winner of claim 1 whereby the at least one means for holding, manipulating, using, battling, competing, playing with the device is at least one handle connected to at least one bladder holder and to at least one bladder inflation system.

5. The device for revealing a winner of claim 1 wherein said at least one switch or other circuit activating and/or deactivating device is comprised of at least one on/off switch.

6. The device for revealing a winner of claim 2 whereby the at least one means to hold in place, secure, snap-in place, attach, twist into place, and/or lock into place the at least one contact attachment further comprises a preset or attachment boss that attaches into the mouth or other part of the at least one bladder, has a check valve, and/or enables the at least one bladder to be snapped, moved, secured, or slid into the at least one means for holding, manipulating, using, battling, competing, playing with the device and/or at least one housing unit.

7. The device for revealing a winner of claim 1 wherein at least one of the at least one locating and/or sensing mechanism, at least one receiver, and/or at least one controller, at least one transmitter, and/or at least one transmitter/receiver can receive and/or transmit at least one of GPS, Wi-Fi, satellite, radio wave, Bluetooth, RFID, sonar, sonic, audio, vibration, light, sound, electronic, UHF, microwave, broad band modulation, amplitude modulation, frequency modulation, spread spectrum, and/or infrared.

8. The device for revealing a winner of claim 1 wherein at least one of the at least one receiver, at least one transmitter and/or at least one transmitter/receiver is attached and/or connected to, and/or partially or wholly located within or inside the at least one locating and/or sensing mechanism and/or is the at least one locating and/or sensing mechanism.

9. The device for revealing a winner of claim 1 wherein at least one of the at least one receiver, at least one transmitter and/or at least one transmitter/receiver is located within or is attached to the at least one controller.

10. The device for revealing a winner of claim 1 wherein the at least one controller is at least one remote control.

11. The device for revealing a winner of claim 1 wherein the at least one controller is at least one of a computer, input device, output device, tablet, smart phone, smart device, sound device, and/or a stationary, handheld, and/or mobile device.

12. The device for revealing a winner of claim 10 wherein the at least one remote control further comprises at least one button or other signal controller that, when depressed, initiated, and/or activated, sends or receives at least one signal to or from at least one of the at least one receiver, at least one transmitter, and/or at least one transmitter/receiver located in the at least one remote control to at least one of the at least one receiver, at least one transmitter, and/or at least one transmitter/receiver located in the at least one locating and/or sensing mechanism.

13. The device for revealing a winner of claim 1 wherein the at least one controlling and/or operating software application, when activated and/or instructed to, sends at least one signal from at least one of the at least one transmitter and/or at least one transmitter/receiver located in the at least one controller to at least one of the at least one locating and/or sensing mechanism and/or the at least one receiver and/or at least one transmitter/receiver located in/on the at least one locating and/or sensing mechanism.

14. The device for revealing a winner of claim 1 wherein said device can be at least one of a toy sword, toy vehicle, toy gun, toy, toy shield, toy wand, doll, toy figure, figurine, toy and/or remote controlled vehicle, toy and/or remote controlled airplane, toy and/or remote controlled helicopter, toy and/or remote controlled rocket, and/or toy and/or remote controlled quadcopter.

15. The device for revealing a winner of claim 1 whereby the device is a toy shield.

16. The device for revealing a winner of claim 15 whereby the toy shield further comprises a sensing means.

17. The device for revealing a winner of claim 16 when there are at least two devices and at least one of the devices is a toy shield and at least one other device is a toy sword whereby the sensing means from the toy shield is a beam/signal and the at least one two sword further comprises a switch attached to a logic circuit port, and a plunger attached to flexible shaft with pin at the end for a mechanical bursting mechanism.

18. The device for revealing a winner of claim 1 wherein the device is a remote controlled vehicle.

19. The device for revealing a winner of claim 18 whereby the remote controlled vehicle further comprises a back assembly, middle assembly, and/or a front assembly.

20. The device for revealing a winner of claim 19 wherein the front assembly, middle assembly, and/or back assembly further comprise at least one of at least one loop;
at least one loop cavity;
at least one weighted and/or unweighted wheel;
at least one propeller;
at least one computer; and/or
at least one wing.

21. The device for revealing a winner of claim 20 wherein the bladder is inflated in the at least one bladder loop cavity.

22. The device for revealing a winner of claim 2 further comprising an external bladder inflation system.

23. The device for revealing a winner of claim 22 wherein the external bladder inflation system comprises:

at least one inflation station (the inflation system housing unit);
at least one inflation button;
at least one inflation nozzle;
at least one compressed fluid cartridge;
at least one electric and/or manually operated pump;
at least one cartridge holder;
at last one cartridge nozzle;
at least one check valve;
at least one inflation chamber;
at least one supply hose;
at least one device valve; and/or
at least one base.

24. A method for using a device for revealing a winner of claim 1 comprising the steps:

attachable and removable bladders of at least two devices are filled (with a gas, solid, mixture, compound, substance, and/or liquid);
attachable and removable bladders of at least two devices are sealed by hand or machine;
attachable and removable bladders of at least two devices are attached and secured to bladder holders that are connected to housing(s), which have and/or handle(s);
the at least one power source in each of the at least two devices powers the at least one logic circuit in each device, which monitors the at least one sensor in each unit; once the at least one logic circuit of any device determines that the sensor indicates a winning event, the logic circuit communicates with at least one other device(s) via transmitters and/or receivers, and the at least other device(s) receives communication through transmitter and/or receivers in the device that the at least one other device(s) should burst its attachable and removable bladder;

when an indication of loss is detected by a logic circuit receiving a loss message at a receiver, a motor that operates a needle or pin is turned on and the needle or pin bursts the bladder; and/or the power switch turns device on and off.

25. The method for using a device for revealing a winner of claim 24 further comprising the steps:

compressed fluid cartridge is inserted into cartridge holder and locked into place with attaching boss(es);

compressed fluid cartridge interfaces with cartridge nozzle to enable inflation nozzle to supply fluid to device valve and fill bladder;

after user installs a compressed fluid cartridge into the inflation station the user then presses the device valve to the inflation nozzle and the inflation button thus releasing contents of the compressed fluid cartridge into the bladder;

compressed fluid cartridge can be replaced by an electric or manually operated pump, which can be inserted and locked into the cartridge holder; and/or inflation button can open the device valve to allow fluid to pass into the bladder.

26. A method for using a device for revealing a winner comprising the steps when the device is at least two devices and at least one device is a toy shield:

sensing means of shield device checks at a predetermined interval to see if the beam/signal is or has been broken;

switch attached to logic circuit port of a toy sword device turns on a plunger attached to a flexible shaft with pin at the end for a mechanical bursting mechanism; if beam/signal sent by transmitter to receiver is broken the user using such device with the broken beam/signal has lost;

logic circuit in shield device notifies the sword device of the losing user via transmitter at the direction of an internal circuit, that it, the non-winning sword device, should burst its bladder and thus inform the winner they have won; upon winning, the sword device of the winning user makes noise, flashes lights and/or vibrates to celebrate;

at least one strap is used to enable player(s) to wear, hang or use a shield device; and/or handle of a sword device, which contains electronics and logic circuit and a bladder is specially made to look like a sharpened sword.

27. The method for using a device for revealing a winner of claim 24 when the device for revealing a winner is a remote controlled vehicle comprising the steps:

bladder is inflated inside the loop cavity of a loop and acts as the middle section of the body of the device;

user(s) controls the device through a controller;

controller is programmed to make vehicle travel a programmed route via commands entered into its on-board computer, which is located on the rear assembly;

vehicle steers via control box based on the commands entered;

control box directs the front wheels and steers them via steering means;

motor(s) driving the wheels move the vehicle;

front and rear wheels are weighted to account for the lack of weight in the bladder body;

rear assembly enables steering by control box, which is controlled by the computer and a wireless communication means linking the front control box to the rear computer, receiving sensors and transmitting sensor;

transmitter from attaching device sends a command and if receiving sensor on an opponent's vehicle can read it the bladder buster assembly will burst the bladder of the opponent's vehicle; and/or the computer controls the steering of the wheels by sending commands through communication means and motor reacts to the commands by moving the wheels at the direction of the user.

28. The device of claim 1 additionally comprising a MAD Button ("mutually assured destruction button").

* * * * *